US007255666B2

(12) United States Patent
Cardenas

(10) Patent No.: US 7,255,666 B2
(45) Date of Patent: Aug. 14, 2007

(54) MULTI-FUNCTION SWING APPARATUS FOR TOTAL-BODY EXERCISE, STRETCHING, YOGA, SPINAL TRACTION, GYMNASTICS, INVERSION THERAPY, SPINAL MANIPULATION AND WEIGHTLESS COUPLING AND SKY CHAIR

(76) Inventor: Anthony J. Cardenas, P.O. Box 3386, Chico, CA (US) 95927

( * ) Notice: Subject to any disclaimer, the term of this patent is extended or adjusted under 35 U.S.C. 154(b) by 315 days.

(21) Appl. No.: 10/934,244

(22) Filed: Sep. 3, 2004

(65) Prior Publication Data

US 2006/0052222 A1 Mar. 9, 2006

(51) Int. Cl.
*A63B 26/00* (2006.01)

(52) U.S. Cl. ..... 482/143; 482/69; 482/23; 482/907

(58) Field of Classification Search ..... 482/69, 482/143, 37, 39, 23, 24, 33, 34, 78, 91, 94, 482/95, 907, 144; D21/665
See application file for complete search history.

(56) References Cited

U.S. PATENT DOCUMENTS 3,593,708 A * 7/1971 Steele ..... 602/32
3,659,594 A 5/1972 Schwab
4,362,151 A 12/1982 Cottrell
4,531,514 A * 7/1985 McDonald et al. ..... 606/241
4,877,238 A * 10/1989 Barrett ..... 482/69
5,209,712 A * 5/1993 Ferri ..... 482/91
5,531,656 A * 7/1996 Varghese ..... 482/69
5,626,540 A * 5/1997 Hall ..... 482/69
5,704,882 A * 1/1998 Coates et al. ..... 482/69
6,790,194 B1 * 9/2004 Katane et al. ..... 602/36
2003/0027696 A1 2/2003 Baumler et al.

* cited by examiner

*Primary Examiner*—Lori Amerson

(57) ABSTRACT

A Multi-Function Swing Apparatus for Total Body Exercise, Stretching, Yoga, Lumbo-Pelvic Traction, Gymnastics, Inversion Therapy, Therapeutic Rehab, Spinal Manipulation, Partner Play and Sky-chair consisting of a nylon fabric swing device having multiple flexible arm member attachments with omni-directional range of motion, a removable foam cushion insert, a metal trapeze pull-up bar, dual extension springs, and two height adjuster straps made of webbing with multiple loops, all of which is suspended from a swivel hook unit attached to a portable structural support stand made of metal tubing.

17 Claims, 9 Drawing Sheets

Front View

Side View

Top Support Unit

Multi-Function Swing Apparatus without Stand

Multi-Function Swing Apparatus Stand
with Top Support Unit and Pivoting Hook

MULTI-FUNCTION SWING APPARATUS FOR TOTAL-BODY EXERCISE, STRETCHING, YOGA, SPINAL TRACTION, GYMNASTICS, INVERSION THERAPY, SPINAL MANIPULATION AND WEIGHTLESS COUPLING AND SKY CHAIR

BACKGROUND FIELD OF INVENTION

This Device relates generally to Exercise Equipment and more Specifically to Multi-Function Exercise and Therapeutic Equipment that provides for a variety of exercises and therapeutic functions within a single device.

BACKGROUND DESCRIPTION OF PRIOR ART

Yoga is a form of postures and exercises practiced to achieve control and balance of the body and mind and spirit along with holistic health and fitness. Patents exists which could be of assistance in performing these exercises including the Ferri U.S. Pat. No. 5,209,712. This patent describes two straps or cables connected to a rectangular bar surrounded by a foam pad and held to a stable structure by "retaining means". This only provides limited support for the exerciser, and positions of exercise are limited by the rigid rectangular bar around which a foam pad is wrapped. The straps which go between the Ferri Patents' support foam and retaining means are very limiting and provide little maneuverability, comfort, or opportunity for exercise during use.

Steele U.S. Pat. No. 3,593,708 shows a bar with foam padding and straps which connect the device to a bar at the end of the straps which support the device from inside a door opening. This obviously limits the exercisers lateral movement and provides no protection from a jarring motion and no means with which to maneuver, exercise, or bounce.

McDonald U.S. Pat. No. 4,531,514 uses a pulley device with which to lift a person for the purpose of inversion therapy and alleviating back pain. This device limits the person strictly to the position of inversion, eliminating all options of exercise, yoga, or mobilization.

Baumler U.S. Pat. No. 20,030,027,696 is described as a Multi-exercise cable gym system. The cable gym in the Baumler patent uses an arrangement of pulleys and cables in conjunction with weights to achieve exercise results. While described as a multi-purpose exercise device the weight and cable system essentially limits this apparatus to strength training.

REFERENCES CITED;

Ferri, U.S. Pat. No. 5,209,712
Steele, U.S. Pat. No. 3,593,708
Macdonald, U.S. Pat. No. 4,531,514
Baumler, Pat. No. 20,030,027,696

OBJECTS AND ADVANTAGES

Several objects and advantages of my invention are to provide a multi-purpose exercise, gymnastic, therapeutic spinal traction and yoga swing apparatus for:

(a) total-body active and passive exercise
(b) total body stretching
(c) strengthening
(d) balance
(e) coordination
(f) agility (g) neuro-muscular re-education
(h) yoga
(i) fun
(j) back, neck and shoulder therapy and rehabilitation
(k) spinal manipulation
(l) lumbar-pelvic traction
(m) weightless coupling
(n) inversion therapy
(o) hammock usage
(p) meditation
(q) sky chair
(r) cervical traction
(s) thoracic traction The omni-directional maneuverability of this multi-handled swing device allows one to achieve practically any posture, movement, stretch or exercise imaginable from virtually any conceivable angle or position whether vertical, horizontal, prone, supine, side-lying, inverted, oblique, or any position in between. It also provides a safe and comfortable way to achieve Inversion Therapy. This design allows one to hang comfortably from the waist and pelvis instead of the feet like other Inversion Tables which can be very stressful to the ankles and lumbar spine. The sling may be opened out in a hammock-like shape and allow the user to sit forwards or sideways, beside sitting on the saddle of the sling with the cushion wrapped within the fabric.

DRAWING FIGURES

Figure 7:
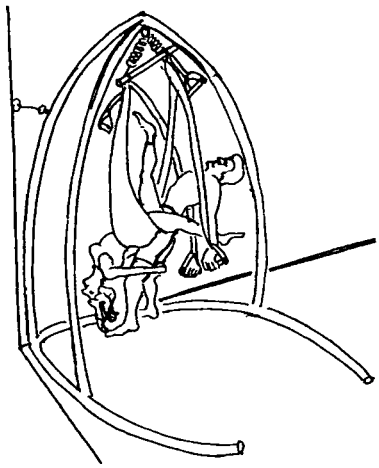

FIG. 7 shows Multi-function Swing apparatus with frame stand 20 and users engaging in tantra yoga or partner play. In this one of many postures, user 'A' sits in sling fabric saddle 22, with or without the cushion, and leans backwards with legs abducted while holding onto user 'B's legs as he balances into user 'A's hips while leaning backwards onto the fabric handle members 24. From this position users may flow and engage into a variety of other fin and pleasurable positions easily.

Figure 8:
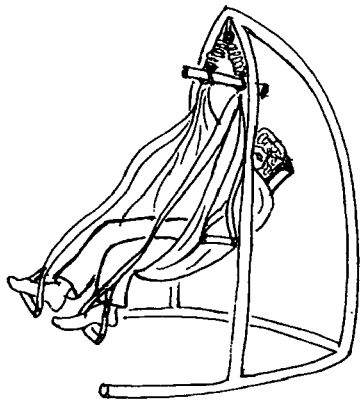

FIG. 8 showing user in the Multi-Function Swing Apparatus and stand sitting in the fabric sling as a 'Skychair' with the fabric fully opened to accommodate sitting, resting the feet on the stirrups 26 and leaning the head onto the cushion 22A. User can sit at any angle whether upright or reclined, and can fully relax while watching TV or sipping on a drink, swaying or bouncing gently with each movement due to the spring action.

Figure 9:
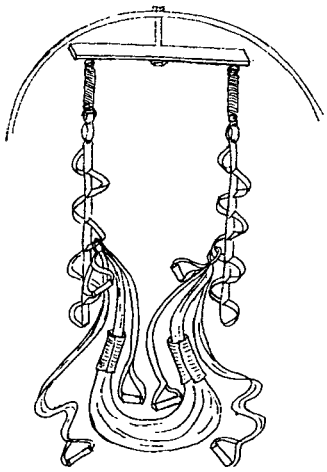

FIG. 9 shows the alternate 'Spin-Spring Suspension Mechanism' whereby the fabric swing 22 hangs from the 'Looped Webbing Height Adjusters' 28 which are suspended from the dual Suspension Springs 34, which hang from closed hooks welded to the undersurface of a ⅜ inch thick by 2 inch×14 inch metal spinning cross bar member, which is attached to a vertical 4 inch long by ½ inch thick bolt or rod which is either welded or bolted to the top of the Support Stand Frame 20. The metal cross bar member has a hole in the exact center of the flat surface so that the vertical metal bolt or rod can fit loosely through it in order to allow the spinning metal crossbar and everything attached to it below to spin if desired by user. Two silicon washers are used between the metal of the spinning crossbar and the head of the bolt or rod beneath the crossbar which supports it to prevent the friction of metal on metal. Alternately ball bearing mechanisms may be used in lieu of silicon washers.

Figure 10:
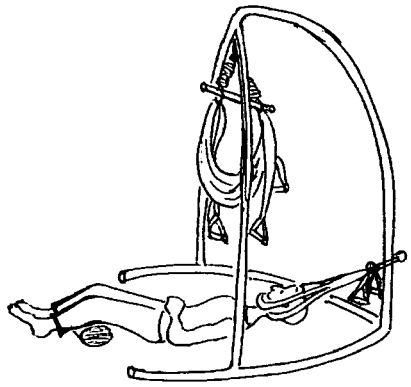

FIG. 10 Showing Multi-function Swing apparatus with frame stand 20 and user lying supine on the floor achieving Cervical Spinal Traction. This is accomplished by simply removing one set of handles with fabric members 24 and hooking the optional Cervical Traction Tone Band Attachment 50 to the middle of the fabric member 24 so that the handles are now equi-distant or even lengths. Attach the end of the Cervical Traction Attachment with the 'S' hook at the other end of the Tone Band to the rear upright pole of the stand (or any stable fixed point). Then slide the foam rubber handle grips up and out of the way in order to expose the sheer fabric. Lie down and wrap the end of one fabric member 24 under the chin and the end of the other fabric member 24 under the occipital region where the skull joins the neck. Cinch both arms of the fabric member 24 tight just above the head with velcrose strap 51 so that fabric member 24 does not slip off your chin or occiput. Relax and scoot your body caudally or towards your feet, thus causing the elastic Tone Band to tighten more until you achieve the necessary pounds of pull or traction needed for pain relief. Then remain in this position for a few minutes or until desired relief is obtained.

Figure 11:
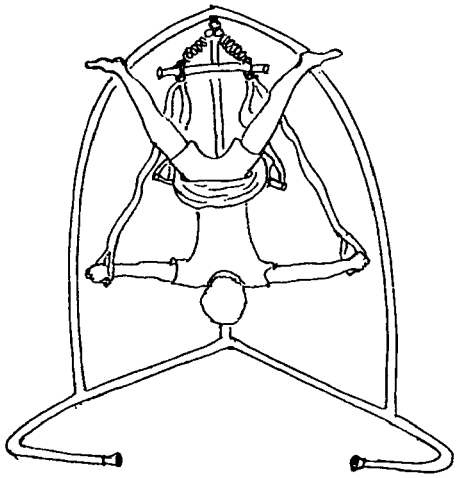

FIG. 11 is a frontal view embodying the invention as a complete unit showing the multi-function swing apparatus consisting of the main sling saddle with four attached flexible arms with handles and the overhead pull-up bar hanging from dual extension springs which is suspended from a centrally located swivel hook attached to the apex of the metal pole frame, along with user hanging inverted in the swing apparatus while holding onto the two lowest stirrup handles for balance and support, both legs extended and abducted to prevent sliding out. User may passively stretch the spine via gravity traction or may perform other exercices while inverted such as abdominal crunches, backbends, trunk rotation and other therapeutic exercises.

Figure 12:
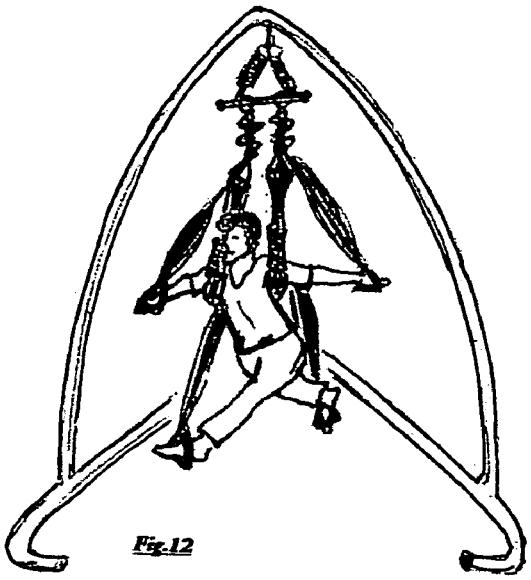

FIG. 12 Showing Multi-function Swing apparatus with frame stand 20 and user performing a forward splits maneuver using handles and stirrups only (without the sling) for total body balancing, strengthening and coordination, as well as for stretching of the hip flexors and the hamstrings and of the legs.

Figure 13:
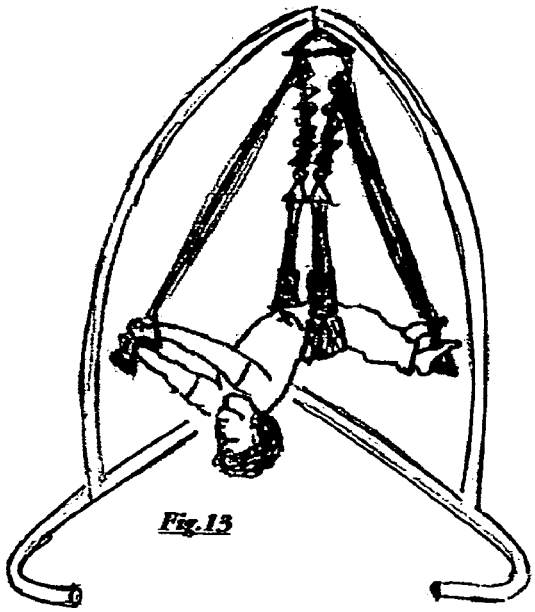

FIG. 13 shows Multi-function Swing apparatus with frame stand 20 and user performing a backbend in the supine position using handles for support while hips rest on sling saddle 22 in order to improve trunk and spine extension and to stretch out tight chest, abdominal, groin and hip flexors. From this position user can flow easily and smoothly into sundry movements and exercises of the legs, arms and trunk with ease, including inversion.

Figure 14:
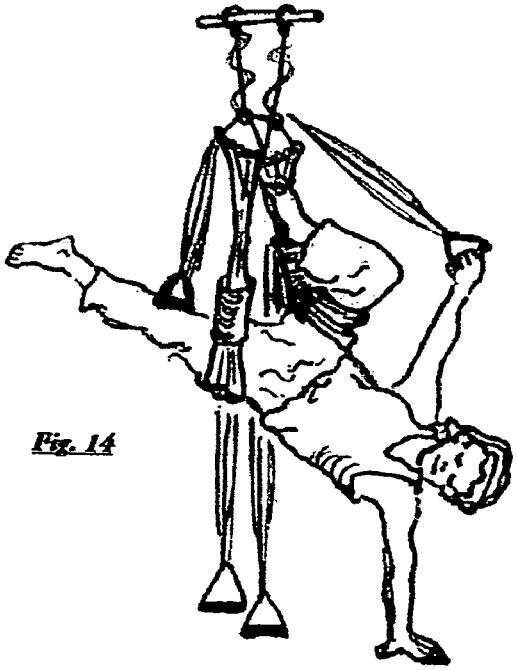

FIG. 14 showing Multi-function Swing apparatus with frame stand 20 and pivot hook 38 with user performing a balancing yoga posture with one hand on the floor and hips in the sling saddle 22 to achieve balance as well as stretching of left waist, thoracic, rib cage and auxiliary area.

Figure 15:
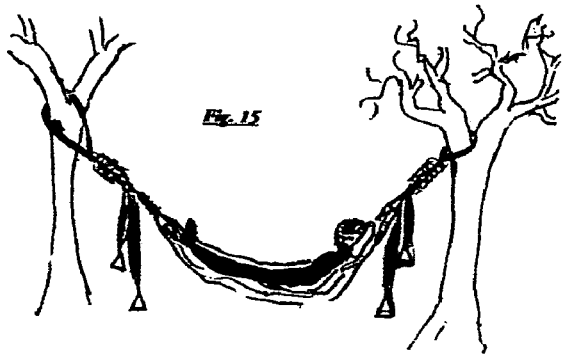

FIG. 15 Shows Showing Multi-function Swing apparatus without frame stand but suspended from branch of two trees with fabric sling 22 fully opened allowing user to recline fully and use this apparatus in hammock style, but incorporating the novelty of Spring Suspension 34 so that user experiences and enjoys a gentle relaxing bounce while redlining and relaxing.

Figure 16:
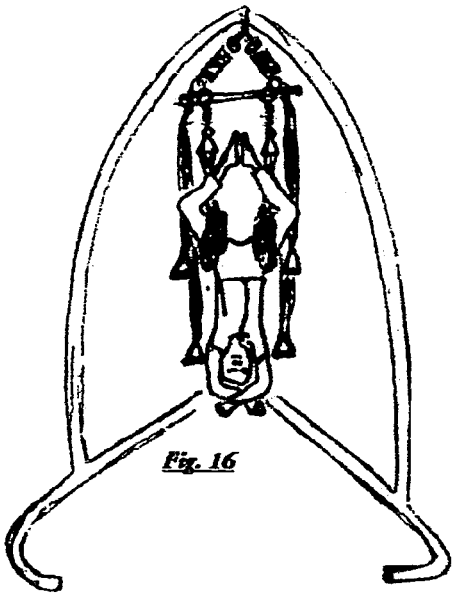

FIG. 16 shows Showing Multi-function Swing apparatus with Frame Stand 20 and Pivot Hook 38 with user achieving Inversion Therapy and passive spinal traction while hanging inverted and locked safely and comfortably upside down with the fabric sling 22 wrapped securely around the thighs. From this position the user can achieve numerous strengthening exercises and auto-manipulations of the spine by performing trunk flexion, extension, rotation, side-bending, crunches, press-ups, handstands, and many other exercises (even using assistive exercise props such as tone bands or dumbbells for greater resistive exercises).

Figure 17:
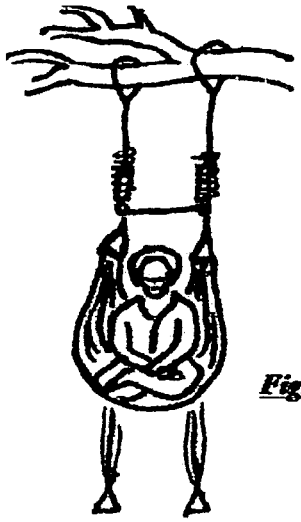

FIG. 17 Showing Multi-function Swing apparatus without frame stand but suspended from branch of a tree with user using this apparatus as a 'Sky Chair' by sitting within the opened fabric sling 22 in a full lotus sitting meditation posture. Optional sitting position can be obtained by user sitting with feet in the stirrups 26 and leaning back into the fabric which is pulled up high to support the upper back and head if desired.

Figure 18:
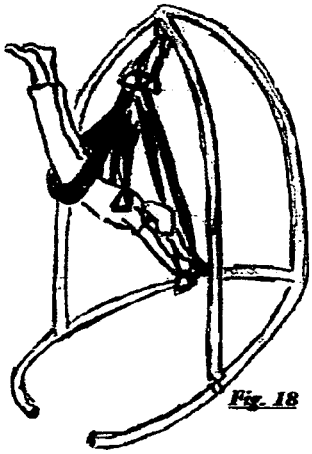

FIG. 18 Showing Multi-function Swing apparatus with frame stand 20 and user performing a semi-inverted total body extension stretch and strengthening maneuver in a prone "diving pose" position, or a modified 'Downward Dog' yoga posture while resting hips or torso in sling fabric 22. Thus stretching the shoulder girdle, anterior trunk and chest while strengthening the back, buttocks, posterior thighs and shoulder girdle. From this position user can also perform many other exercises and stretches such as trunk side-bending, flexion, extension, crunches, and various chest exercises.

Figure 19:
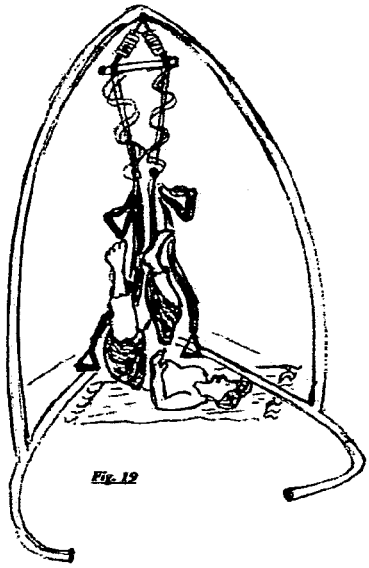

FIG. 19 Showing Multi-function Swing apparatus with frame stand 20 and user engaging in lumbar pelvic traction with his hips suspended on the sling just a few inches off the floor while the upper back rests squarely on the floor. After totally relaxing and stretching the Lumo-sacral for several minutes in this passive traction posture, user can then proceed to active Range of Motion exercises of trunk and pelvis, auto-manipulation and mobilization of the lumbar spine, and muscle strengthening exercises of the lumbar-pelvic region—all with hips in sling and upper back still on the floor.

Figure 19A:
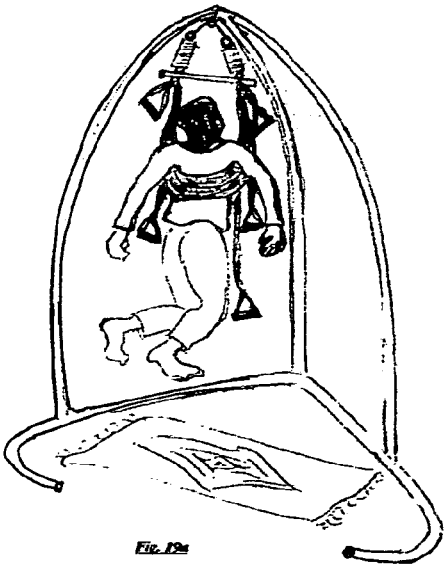

FIG. 19*a* shows Multi-function Swing apparatus with frame stand 20 and user hanging upright from his axillary region and upper trunk, being suspended from the sling saddle 22 and cushion insert 22A for comfort and protection. From this position user can achieve upright gravity traction by simply keeping the feet suspended off the floor or by resting the feet lightly on the floor so that total body relaxation can be achieved. The fabric sling 22 with the cushion insert 22A can be adjusted higher or lower on the spine in order to achieve mobilization at different levels of the thoracic spine. Numerous other positions, stretches and mobilizations of the facet joints, ribs or sternum can be attained by resting the feet either in the foot stirrups or upon the floor while stretching the trunk forward, sideways, backwards or into more rotation.

REFERENCE NUMERALS IN DRAWINGS

20 Frame
22 Fabric Sling
24 Fabric Arm Member with Hand Grip
25 Adjustable Protective Pad
26 Fabric Arm Member with Foot Stirrup

28 Sling Webbing Looped Harness
30 Support Bar
32 Rubber Positioning Rings
34 Springs
36 Nylon Webbing Connectors
38 Swivel Hook Mechanism
42 Frame Base
44 Frame Adjuster

DESCRIPTIONS

Figure 1:
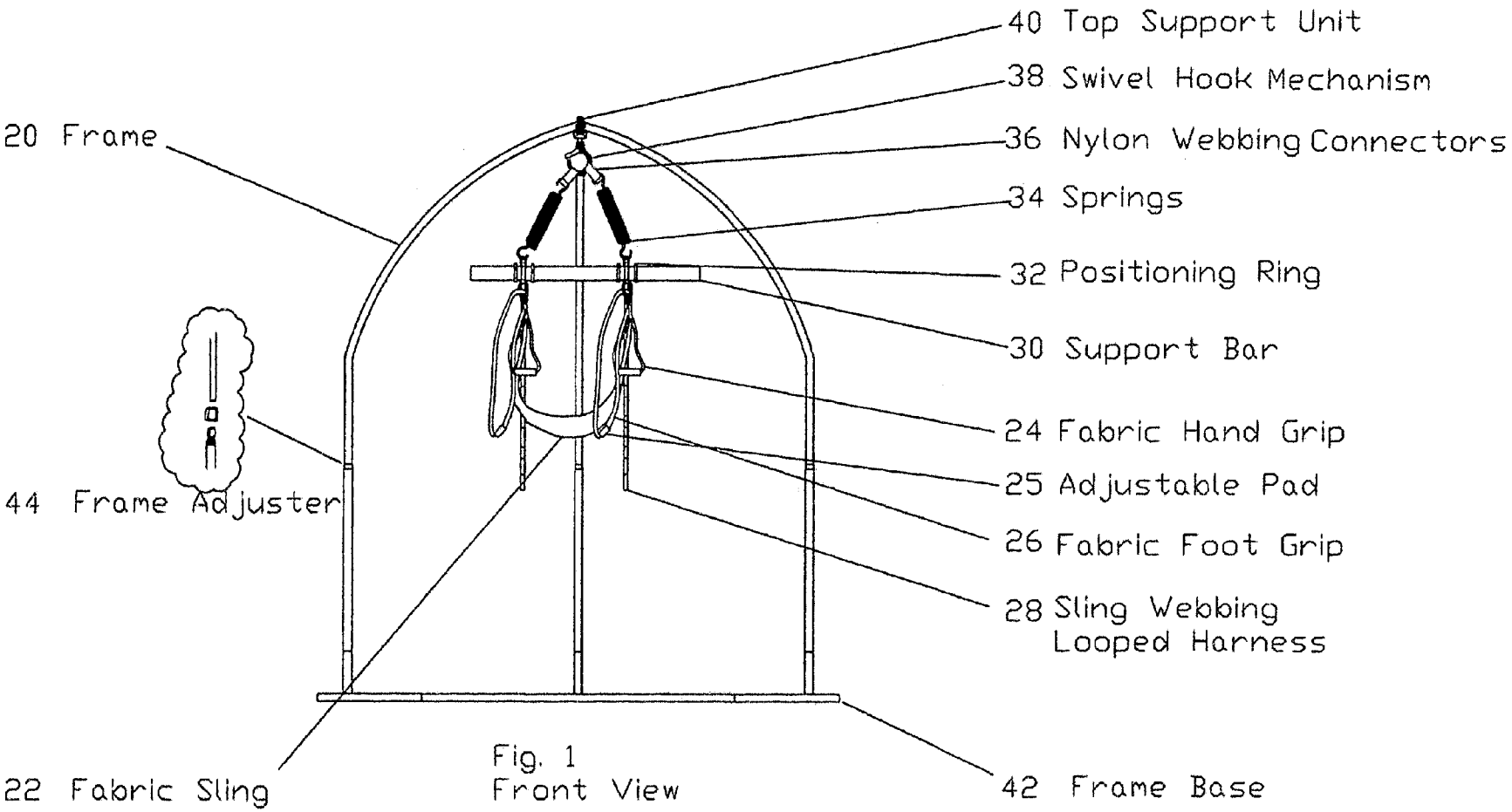
FIG. 1 Shows a front view of the Multi-Function Swing Apparatus.
Figure 2:
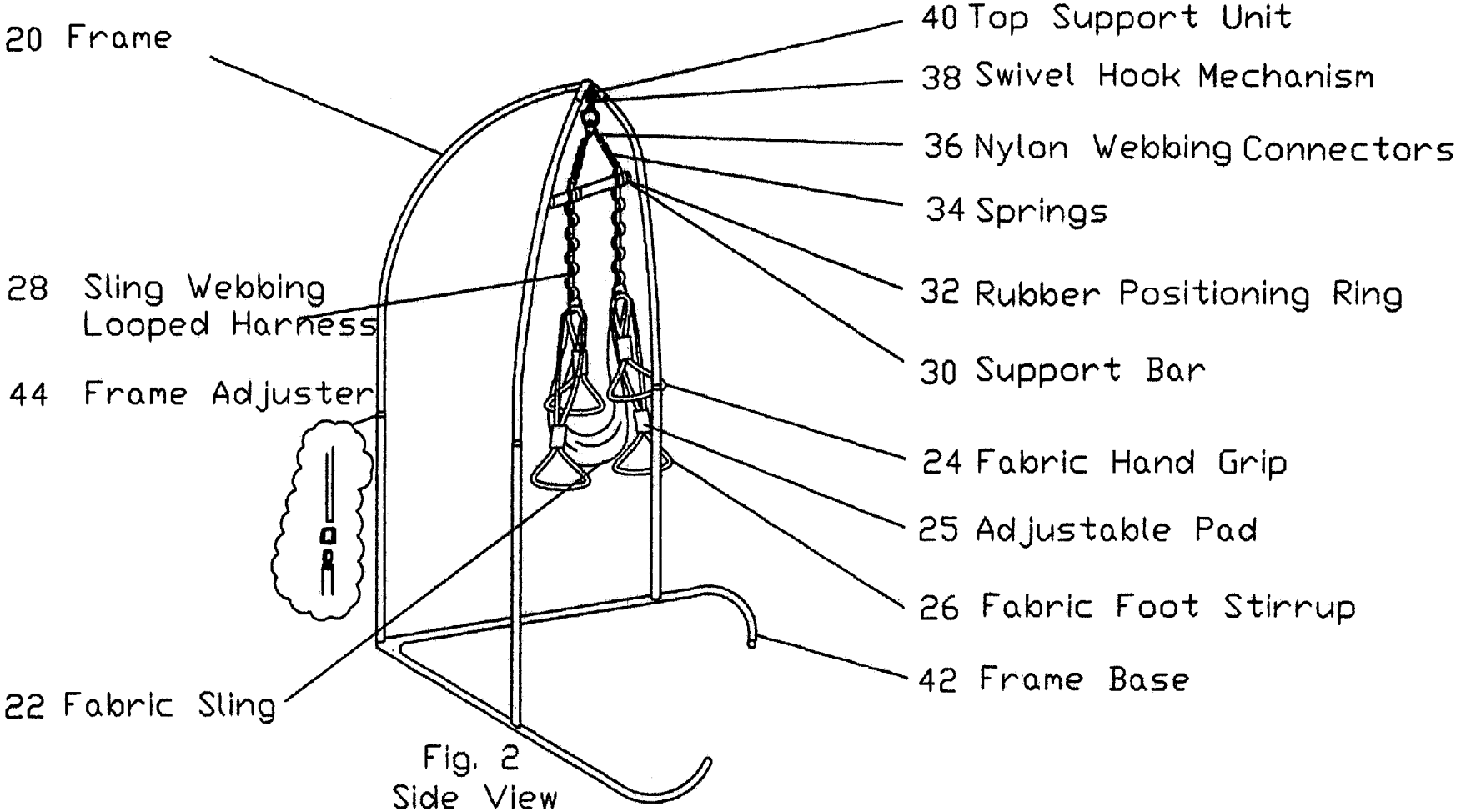
FIG. 2 Shows a side view of the Multi-Function Swing Apparatus.
Figure 3:
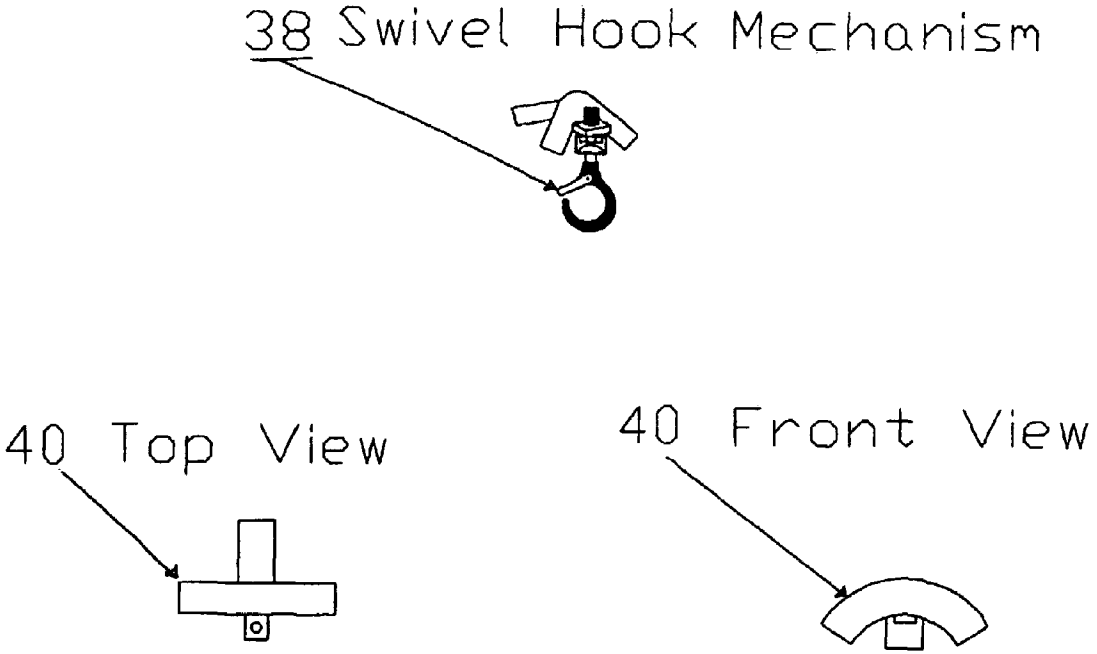
FIG. 3 Shows a front view of Frame 20 in Exploded View with Frame Base 42 and Swivel Hook 38.
Figure 4:
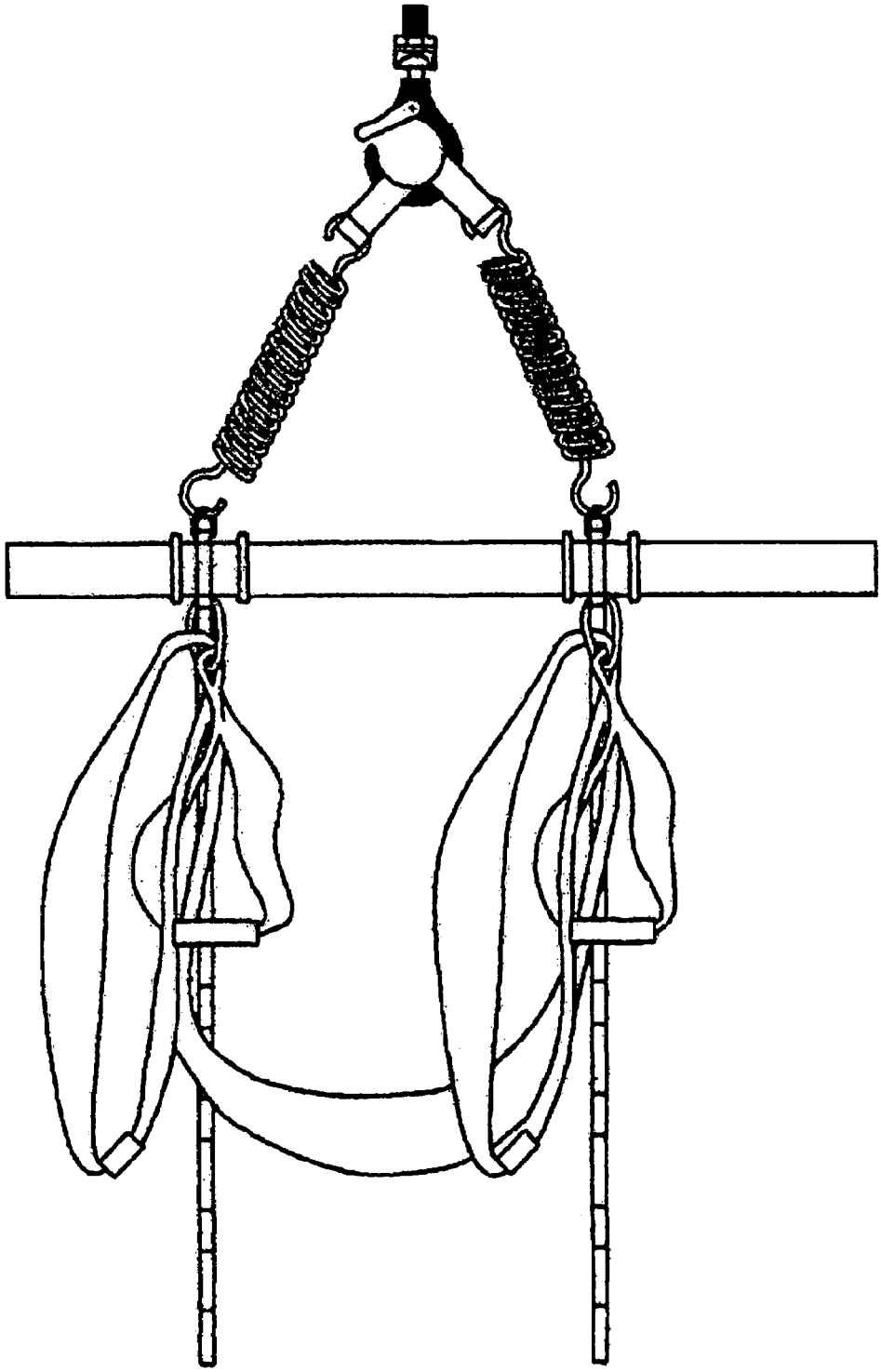
FIG. 4 Shows Multi-Function Swing Apparatus without Stand 20.
Figure 5:
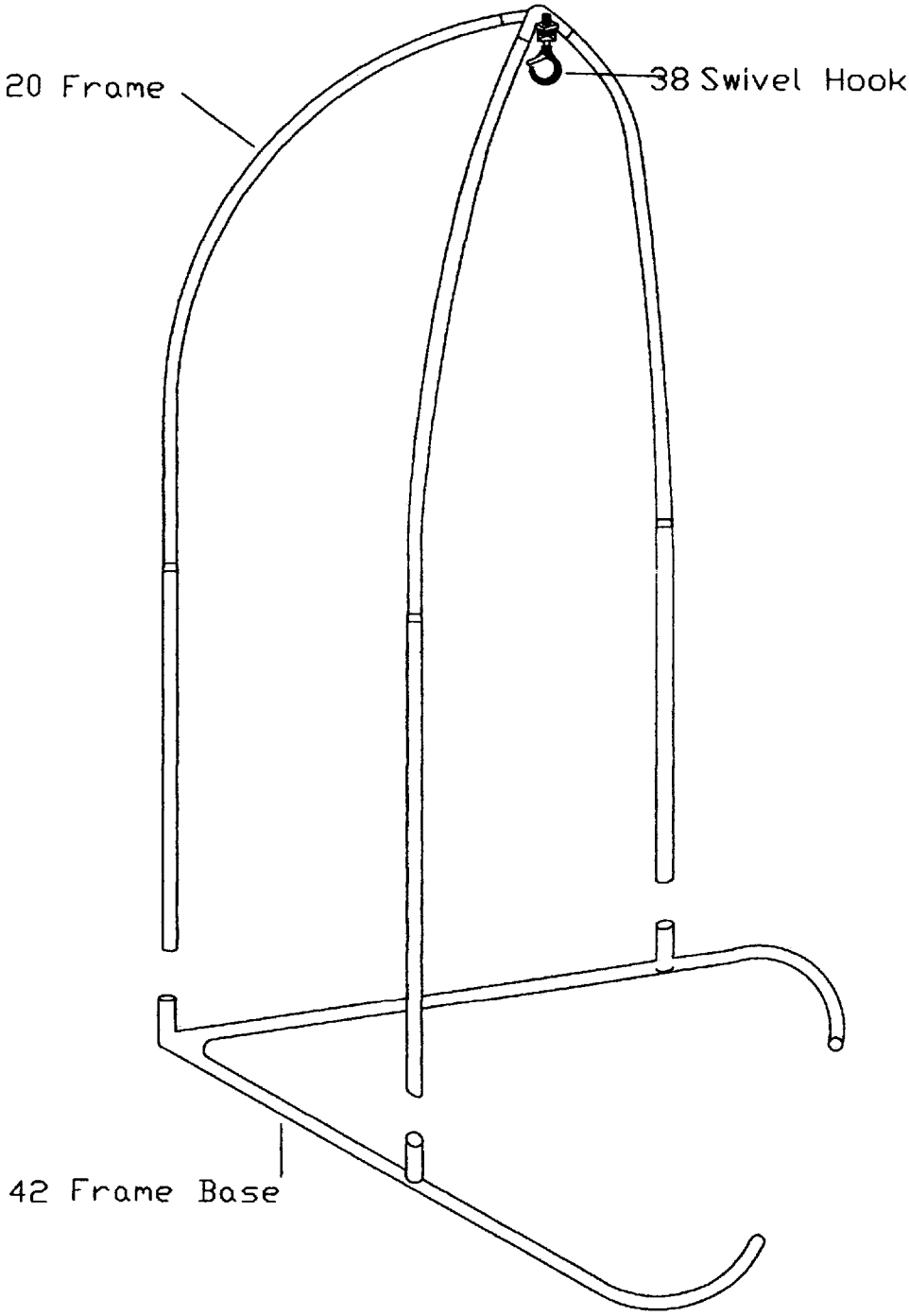
FIG. 5 Shows Multi-Function Swing Apparatus Stand 20 with Frame Base 42 and Swivel Hook 38
Figure 6:
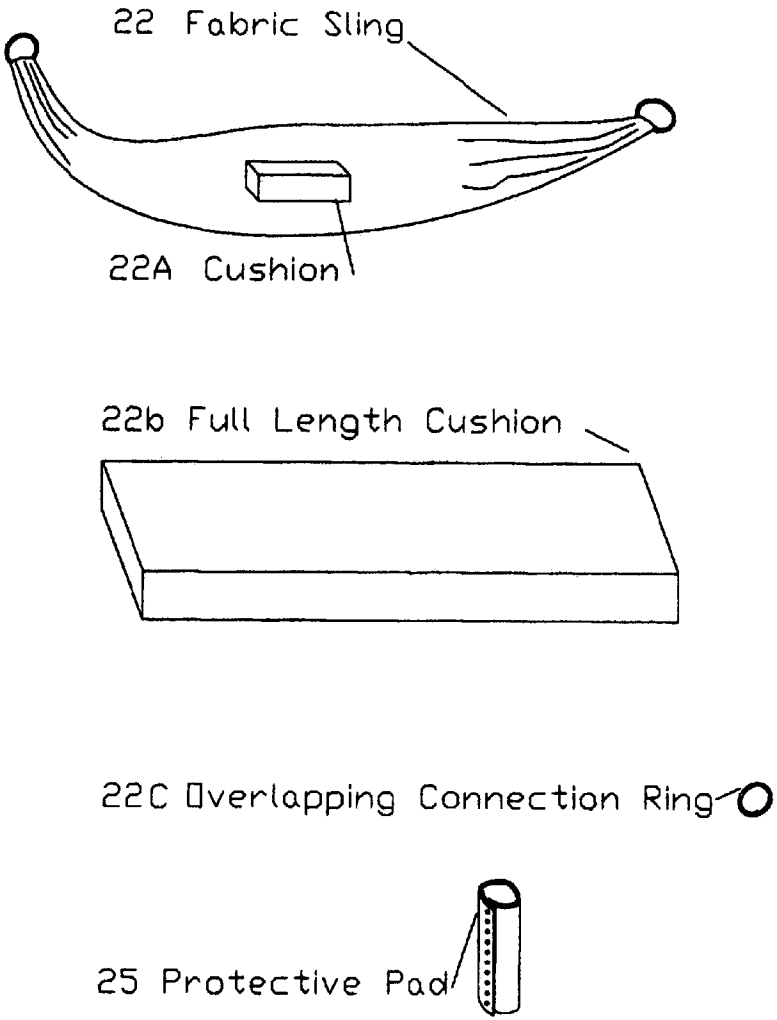
FIG. 6 Shows Fabric Sling 22 with Cushion 22*a*, Full Length Cushion 22*b*, and Overlapping Connection Ring 22*c* and Protective Pad 25.

A preferred embodiment of my invention shows FIG. 1 a front view and FIG. 2 a side view of the Multi-Function Swing Apparatus. Frame Base 42 with Frame 20 assembled and attached Frame 20 is constructed of inter-locking metal tubing approx. 1½" in diameter. Steel Swivel Hook 38 is attached to a welded plate at the top of Frame 20. Swivel Hook 38 is bolted through hole in plate and tightened with conventional nut and washer assembly.

Two Extension Springs 34 are attached to Swivel Hook 38 by hook-end through Long Steel Springs 34 opening. Springs 34 is hooked through Sling Webbing Looped Harness 28 are spaced equa-distance from center of Long Teak Wood Support Bar 30. Four rubber 1½" Positioning Rings 32 hold Sling Webbing Looped Harness 28 securely in place, restricting any lateral movement of webbing loops. Fabric Sling 22 7and Fabric Arm Member with Hand Grip 24 and Fabric Arm Member with Foot Stirrup 26 is attached to Sling Webbing Looped Harness 28 with Overlapping Connection Rings 22*c* or Carabener Hooks. Varying Length Fabric with Fabric Arm Member with Hand Grip 24 and Varying Length Fabric with Foot Stirrups 26, with Adjustable Protective Pads 25 used to protect users thighs and arms from rubbing on all parts using fabric, are attached anywhere on Sling Webbing Looped Harness 28. Right and left sides of Fabric with Hand Grips 24 and Fabric with Foot Stirrups 26 can be attached to Sling Webbing Looped Harness 28 at the same elevation as the Fabric Sling 22 or at different heights for different exercises and users. Various sized cushions such as Full Length Cushion 22*b* may be substituted for Cushion 22*a* allowing user entirely different application possibilities. A Foot "Booty" or Velcro Wrap may be attached to the Foot Stirrups 26 for greater comfort and more secure foothold for certain maneuvers such as simulated skiing or flips.

Height of Fabric Sling 22 or Hand Grips 24 or Foot Stirrups 26 can be raised as high or as low as desired for engaging in different usages or exercises including but not limited to lowering the Fabric Sling 22 just a few inches off the floor for applications such as lumbar-pelvic traction (FIG. 17). FIG. 17 Showing Multi-function Swing apparatus without frame stand but suspended from branch of a tree with user using this apparatus as a 'Sky Chair' by sitting within the opened fabric sling 22 in a full lotus sitting meditation posture. Optional sitting position can be obtained by user sitting with feet in the stirrups 26 and leaning back into the fabric which is pulled up high to support the upper back and head if desired.

Angle of Frame Base 42 is approx. 75–90 degrees. Overall height is approx. 8 feet tall and 3 to 3½ feet wide. The frame base is designed to fit in the corner of any room in the house, just under standard 8' ceiling height and without taking up much floor space. The rear pole fits snugly against the corner of the room and the front two poles fit alongside the two adjacent walls. The 3 vertical poles curve in 45 degrees out the top and join together to lock into a base assembly via plevis pins. The rear pole is spaced approx. 4 feet from each of the front 2 poles, and the 2 front poles are spaced 5 to 6 feet apart. The 2 horizontal frame base poles have an angle anywhere between 75 and 90 degrees and extend out 3 feet beyond the 2 front vertical poles, then curve forward and inward to provide the proper stabilization. The rear pole can be strapped to the corner stud of a structure by means, for example, of an eye-bolt. The base may be divided into sections for shipping purposes, as can any length of frame assembly, and re-assembled through hole and pin connections, for example.

Above description describes one embodiment, the preferred embodiment. Alternatively, different materials and connections can be substituted for the parts and materials specified

Operation

There are numerous variations on exercises possible with the Multi-Function Swing Apparatus. Listed are a few of the possible use combinations.

Yoga Postures, Gymnastics and Stretching

The user may mount the Swing Apparatus from any one of several approaches. In FIG. 12 the user will have mounted the swing by first sitting upright on the Fabric Sling 22 where the foam cushion 22*a* is wrapped within the fabric, pulling himself up either with the Support Bar 30 or the two Upper Hand Grips 24. The user then slips his feet into the two Fabric Foot Stirrups 26 and holds the two Hand Grips 24 while the Fabric Sling 22 rests underneath his armpits for extra support. He then attempts to engage his body into a wide variety of balancing and strengthening movements, stretches, and exercises according to his tolerance, strength and agility such as standing with the legs and arms in various positions, simulated ambulation, forward or lateral leg splits, etc. As he gains skill and strength he may progress to this exercise series without using the Fabric Sling 22 for support. These postures can either be static or dynamic as tolerated or desired. The two Springs 34 allow a smooth and pleasurable bounce effect to the movements. The Swivel Hook 38 allows the user to rotate and spin gently as desired. In FIG. 14 the user mounts the Fabric Sling 22 by sitting on it upright, then while holding onto the right Fabric Hand Grip 24 with his right hand, he proceeds to lean his body left slowly until he can touch the floor. Balancing on one hand on the floor, the other hand on the Middle Hand Grip 24 and his hips on the Fabric Sling 22, he flexes his right knee and presses his right foot into the Fabric Sling 22. In this semi-inverted position he can now stretch into side-bending, rotation or extension while strengthening shoulder, trunk, hips, and thighs. The postures can be static or dynamic as desired.

Spinal Traction—See FIG. 19 under the Drawing Figures section for further details, drawing and textual description of the Lumbo-Pelvic spinal traction function, and FIG. 10 for the Cervical Traction function on the swing apparatus.

Inversion Therapy—See FIG. 11 or 16 under the Drawing Figures section for further details, drawing and textual description of the Inversion Therapy function.

Sky Chair—See FIG. 8 or 17 under the Drawing Figures section for further details, drawing and textual description of the Skychair function.

Hammock Style—Fabric Sling 22 may be opened and spread wide apart and fastened between two trees or any two sturdy stationary objects. The user climbs in the Fabric Sling 22 and lies down comfortably inside the opened Fabric Sling 22 as a hammock type function.

Tantra Yoga Weightless Coupling—See FIG. 7 under the Drawing Figures section for further details, drawing and textual description of the Weightless Coupling function, and FIG. 10 for the Cervical Traction function on the swing apparatus.

SUMMARY, RAMIFICATION, AND SCOPE

Accordingly, the reader will see that this invention allows for many different types of exercises and therapeutic functions to be performed. Also the invention allows the user an almost unlimited variety of positions from which to exercise making it the most unique and ultimate Swing Exercise Apparatus on the market.

Some of the advantages of this invention which are unique include:

Maneuverability—other inversion units are allow little room for movement, while this invention is designed for total body movement, and a virtual infinite range of motion in all directions.

Exercises and stretches are unlimited in the sense that new movements, stretches or exercises will continue to be discovered as the user herself increases in strength, flexibility, agility and ability to do more.

Comfort—This unit is more comfortable due to the use of springs and a thick foam or cotton cushion in the apron sling.

Spring Action—Extension springs (or bunji cords) not only make it fun to play on but give added comfort for a smooth, gentle and cushioned bounce effect during use. No other known patented version uses springs in this fashion.

Inversion Therapy—Our very Life begins with 9 months inverted and bouncing gently with every step mother takes, so inversion is an original and natural state as any other. Perhaps that's why it is so relaxing, therapeutic and feels so good. Besides allowing one to hang comfortably from the pelvic-waist area instead of by the feet as with other inversion units, the superiority of this design allows you not only to hang either forward and backwards during inversion, but also one can flex, extend or rotate the trunk in order to accomplish stretching, strengthening and joint mobilization of the spine. No other inversion device has such maneuverability or variety as this. The best existing inversion devices are very limited in mobility and fixed in space (see U.S. Pat. No. 3,593,708 and U.S. Pat. No. 4,531,514). Multiple handles and a pull up bar attached to the swing apparatus at various levels allow for a greater variety of stretches, exercises and movement pattern combinations than any other known exercise device. The nearest design and competitor to my invention is U.S. Pat. No. 5,209,712, and shows only one handle on their design.

Multi-purpose—A hammock-like option becomes available for relaxation by simply removing the thigh pads, secured by velcro, and seat cushion, then suspending either end of the sling apart between two trees, using the cushion for a pillow.

Portability—My Multi-Purpose Exercise Gym is compact and lightweight it can be transported in a knapsack or luggage to be set up from any big branch of a tree during camping or from any rafter, beam or ceiling frame in any building. The optional support frame structure is also lightweight, portable, adjustable and easy to reassemble.

Adjustability—not only can the multiple handles be adjusted in height levels, but the sling or apron can be adjusted in height or width to accommodate different exercises, movements or uses.

Neuro-Muscular Re-education—due to the multiple handles and postures and movements this apparatus affords makes it an ideal physical therapy device for neuromuscular re-education, re-patterning, exercises, and rehabilitation.

Floating Meditation—no other patented device affords the option for suspended or floating meditation as this invention does.

Spin Capability—no other inversion or exercise device uses an optional swivel hook to hang pelvic sling from, which gives it the added capability of spinning while upright or inverted.

Tone Bands and other props—Attached to the support frame at varying heights are bunji-style tone bands which allow for a variety of resistance exercises of the trunk and extremities. The poles work themselves as props and handles for even more exercises, poses and stretches.

Versatility—My invention provides a wide variety of applications and exercises including yoga, inversion therapy, strengthening, stretching, gymnastics, meditation, hammock use, skychair use, fun, proprioceptive exercise training and neuro-muscular re-education.

Options—Optional accessory exercise props which are not attached to the device can be utilized with this yoga blocks, dumb-bells, therapy balls, shoulder-stand and hand-stand devices.

I claim:

1. An extremely versatile multi-function exercise, therapy, inversion, traction, and yoga swing apparatus designed for engaging, supporting, lifting, hanging, stretching, stabilizing, or providing resistance to either all or a portion of the user's body or limbs from a multi-handled swing device which can be suspended from a portable structural support frame in order to allow user to perform any of a large multiplicity of exercises, movements, postures or functions ranging from inversion therapy (hanging upside down), spinal mobilizations, and pelvic or cervical traction to gymnastics, yoga exercises, total body stretching or strengthening, partner play, simple relaxation, and physical therapy or musculo-skeletal rehab, and which said apparatus consists of:

a). one user engagement member comprising a rectangular shaped nylon fabric sling whose central section or saddle portion hangs freely downward once both upper ends of the sling member are releasably secured via spring hooks to both ends of an overhead pull-up bar which hangs horizontally suspended from the support frame, and which sling member has the option to be used either in an open position whereby user can sit or recline inside of it or in a closed position whereby the fabric is wrapped snugly around an optional cushion folded inside the horizontal saddle portion of the sling member, whereupon user can either sit upon, straddle over it, entwine within it, or lean any specific body part against it for any one of its many uses of supporting, hoisting, lifting, rotating, inverting, or suspending either the user's trunk, pelvis, lower limbs or whole body off of floor surface at variable heights, neutralizing the forces of gravity and facilitating the performance of any of the above stated functions, positions, movements or exercises, b). a rectangular shaped removable foam cushion of 3"×8"×36"× dimensions designed for optional insertion into the fabric sling member by means of rolling and wrapping it snugly within the saddle portion of the sling member in order to provide either a localized or generalized cushioning effect to the spine during spinal mobilizations, or to the waist during pelvic traction, or to the inner thighs during inversion or hanging upside down maneuvers, c). one user engagement member comprises an overhead, horizontal, metal trapeze pull-up bar element approximately 18 inches in length by 1 inch diameter round, and whose opposing ends are releaseably secured to the main body of the swing apparatus below it and to the dual extension springs above it by means of selectively positioned safe-lock mechanism spring hooks or carribeners, and which purpose thereby is to allow user's hands to grasp onto to perform vertical pull-up exercises, or to hoist body upwards and assist user engagement into the sling saddle, or to allow user's toes to hook onto for greater limb extension or security during inversion therapy maneuvers, d). six separate rope-like, fully flexible, and omni-directional user engagement arm members made of nylon fabric with polyurethene foam covered hand-grips attached to and hanging freely from the bottom ends once the top ends of said arm members have been releasably secured via secure spring hooks onto either end of the pull-up bar and springs above it; and whereas said six user engagement arm members are comprised of two short overhead arm members whose handle hangs approximately one foot below the level of the pull-up bar, two medium length arm members whose hand-grips hang at approximately the level of the sling saddle or waist height, and two full length fabric arm members having foot stirrups hanging approximately a foot below saddle level; and which function of said arm members having fully flexible, omni-directional ranges of motion are to permit user the greatest variety of function and nearly unlimited combinations of movements and exercises on said yoga therapy swing apparatus, e). two adjustable protective foam pads covered with a fabric cover secured with velcrose strips that allow it wrap snugly around the vertically hanging sides of the fabric sling member for the dual purpose of clamping the fabric tightly on either side of the removable cushion within the saddle portion of the sling to prevent it from slipping out, as well as to provide a protective cushioning for either the inner thighs of the user while hanging upside down during inversion therapy or to the axillary regions of the user during thoracic mobilization maneuvers, f). at least two sturdy, closed loop-end extension springs of variable weight loads which are releaseably secured to the trapeze pull-up bar member below and to the swivel hook mechanism which hangs from the apex of the support stand structure above, and which extension springs allow the user to experience a gentle bounce effect and soft end-feel rather than a hard end feel during the various maneuvers, thereby allowing greater comfort, pleasure, relaxation or ease of movement during use of said exercise therapy swing apparatus, g). two flexible means 3 foot long webbing height-adjuster strap members having a plurality of discrete attachment loops secured in sequential linear alignment thereon, and which height-adjuster straps are releaseably secured and suspended from both ends of the trapeze pull-up bar member, thereby allowing either the fabric sling harness member or any two of the six detachable fabric arm members to be lowered or raised to any height between floor level to waist height by means of the safety spring hooks which insert and detach easily from any one of the sequentially spaced loops in order to allow for selective positioning to specific portions of the user's body or to allow for an even greater variety of maneuvers, exercises, functions or positions possible on said multi-function swing apparatus, h). one 7'11" high structural support frame made of 1¼ inch diameter 16 guage steel tubing designed to fit just under the standard 8' high ceiling, and which frame is comprised of a horizontal steel tubing frame base component which angles and curves so as to form a circular or 'U' shape as it rests securely on the floor to form the structural support means for the entire apparatus, and which frame base has three 8 inch vertical steel tubing extensions protruding upwards and at right angles from the horizontal base poles; and which vertical tubing extensions of said frame base serve to house and support the lower female ends of three vertical upright poles which slide and lock into them, and which vertical poles are triangularly spaced apart for structural stability as they arch and bend upward and inward to conjoin at the 7'11" high apex of said structure by sliding and locking into the three female ends of the top triplex unit, and which top tri-plex unit is comprised of three steel tubing short arm extensions which angle downward and outward in a triangular fashion to conjoin the top ends of the three upright poles; and which all poles and steel tubing of said support frame consist of shorter four foot segments which have swedged joints that slide into one another and pin-lock together quickly and easily via pelvis pins for ease of shipping, assembly and portability, i.) a single ball bearing swivel hook unit welded to the center and underside of the top triplex unit which sits at the apex of the structural support frame assembly, and which purpose of swivel hook means is to allow an even greater variety of movement and fun on the multi-function swing apparatus, namely turning, spinning, rotating, and twisting exercises or stretches.

2. A versatile multi-function exercise, therapy, inversion, traction, and yoga swing apparatus according to claim 1 whereas a spring loaded ball-in-hole snap-lock mechanism is used in lieu of pin lock via clevis pins for connecting all swedged joints of each segmental unit of the structural support frame.

3. A versatile multi-function exercise, therapy, inversion, traction, and yoga swing apparatus according to claim 1 whereas the Support Frame uses a plurality of telescoping upright poles in lieu of interlocking segments with swedged joints.

4. A versatile multi-function exercise, therapy, inversion, traction, and yoga swing apparatus according to claim 1 whereas Fabric Sling uses a shorter 2"×6"×24" Fabric Cushion in lieu of the Full Length 3"×8"×36" cushion.

5. A versatile multi-function exercise, therapy, inversion, traction, and yoga swing apparatus according to claim 1 whereas Fabric Sling is made of hemp, cotton or canvas in lieu of parachute nylon fabric.

6. A versatile multi-function exercise, therapy, inversion, traction, and yoga swing apparatus according to claim 1 whereas Frame is made of Fiberglass Re-inforced Plastic (FRP) in lieu of metal tubing.

7. A versatile multi-function exercise, therapy, inversion, traction, and yoga swing apparatus according to claim 1 whereas Frame is made with either 3 or 4 wooden poles in tri-pod or quad-pod fashion in lieu of metal tubing.

8. A versatile multi-function exercise, therapy, inversion, traction, and yoga swing apparatus according to claim 1 whereas durable Bunji Cords are substituted for closed loop extension springs.

9. A versatile multi-function exercise, therapy, inversion, traction, and yoga swing apparatus according to claim 1 whereas more or fewer Springs may be added to compensate for various users weight loads.

10. A versatile multi-function exercise, therapy, inversion, traction, and yoga swing apparatus according to claim 1 whereas electric powered motor may be incorporated into the suspension components in order to allow for gentle continuous passive swinging or bouncing action for promoting greater relaxation, pleasure, fun and circulation effects.

11. A versatile multi-function exercise, therapy, inversion, traction, and yoga swing apparatus according to claim 1 whereas height of multi-function swing apparatus may be manually controlled by a mechanical pulley and cable device in lieu of looped webbing height adjuster straps.

12. A versatile multi-function exercise, therapy, inversion, traction, and yoga swing apparatus according to claim 1 whereas height of multi-function swing apparatus may be controlled by hand held remote control connected to an electrical pulley device in lieu of looped webbing height adjuster straps.

13. A versatile multi-function exercise, therapy, inversion, fraction, and yoga swing apparatus according to claim 1 whereas device uses only four fabric arm members with hand grips and foot stirrups instead of six.

14. A versatile multi-function exercise, therapy, inversion, traction, and yoga swing apparatus according to claim 1 whereas device uses an alternate dual-point suspension from a rotating blade mechanism welded or bolted to the underside of the top tri-plex unit in lieu of a single point suspension from the swivel hook unit, thus also eliminating the need for the overhead trapeze bar which generally serves to keep the sides of the fabric sling form collapsing onto each other when a single point suspension is used.

15. A versatile multi-function exercise, therapy, inversion, traction, and yoga swing apparatus according to claim 1 whereas device uses a wooden trapeze pull-up bar in lieu of a metal bar.

16. A versatile multi-function exercise, therapy, inversion, traction, and yoga swing apparatus according to claim 1 whereas Foot Stirrups are replaced by a soft Foot Booty which has a firm but flexible sole base and sides to contain user's feet more fully and securely without risk of slippage.

17. A versatile multi-function exercise, therapy, inversion, traction, and yoga swing apparatus according to claim 1 whereas device uses two polyethelene foam rubber hand grips for better grip on the trapeze pull-up bar.

* * * * *